US008257194B2

(12) United States Patent
Stites

(10) Patent No.: US 8,257,194 B2
(45) Date of Patent: Sep. 4, 2012

(54) DEVICE FOR STIFFENING A GOLF CLUB SHAFT

(75) Inventor: John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 73 days.

(21) Appl. No.: 12/565,307

(22) Filed: Sep. 23, 2009

(65) Prior Publication Data

US 2011/0070968 A1 Mar. 24, 2011

(51) Int. Cl.
*A63B 53/08* (2006.01)

(52) U.S. Cl. ..... 473/319

(58) Field of Classification Search ..... 473/316–323
See application file for complete search history.

(56) References Cited

U.S. PATENT DOCUMENTS

| | | | | |
|---|---|---|---|---|
| 4,725,060 | A * | 2/1988 | Iwanaga | 473/289 |
| 5,294,119 | A * | 3/1994 | Vincent et al. | 473/318 |
| 5,429,358 | A * | 7/1995 | Rigal et al. | 473/309 |
| 5,478,075 | A | 12/1995 | Saia | |
| 5,976,032 | A * | 11/1999 | You | 473/319 |
| 6,231,457 | B1 | 5/2001 | Chen | |
| 6,825,315 | B2 * | 11/2004 | Aubert | 528/393 |
| RE38,983 | E | 2/2006 | Antonious | |
| 7,029,402 | B2 * | 4/2006 | Nakajima | 473/309 |
| 2001/0011042 | A1 | 8/2001 | Roark | |
| 2004/0214978 | A1 * | 10/2004 | Rosin et al. | 528/44 |
| 2005/0255935 | A1 * | 11/2005 | Yanagisawa et al. | 473/316 |
| 2010/0323809 | A1 * | 12/2010 | Murphy | 473/314 |

FOREIGN PATENT DOCUMENTS

| | | |
|---|---|---|
| GB | 2 053 698 | 2/1981 |
| JP | 08-057090 | 3/1996 |
| JP | 09225078 A * | 9/1997 |
| WO | 2010/132285 | 11/2010 |

OTHER PUBLICATIONS

Computer English Translation of JP 09225078A.*
International Search Report and Written Opinion issued on Feb. 7, 2011 in corresponding PCT/US2010/045973.
International Preliminary Report on Patentability issued in corresponding International Application No. PCT/US2010/045973, mailed Apr. 5, 2012.

* cited by examiner

*Primary Examiner* — Stephen L. Blau
(74) *Attorney, Agent, or Firm* — Banner & Witcoff, Ltd.

(57) ABSTRACT

A device for stiffening a golf club shaft which includes a strip of material configured to engage the exterior of the golf club shaft. The longitudinal axis of the strip may be configured to extend in a direction parallel to a longitudinal axis of the golf club shaft when the strip engages the golf club shaft. The strip may be configured to increase the stiffness of a portion of the golf club shaft when the strip engages the portion of the golf club shaft. The strip may include longitudinal fibers configured to extend in a direction parallel to a longitudinal axis of the golf club shaft when the strip is engaged to the exterior of the golf club shaft. An associated method for fitting a golf club with a shaft stiffening device is also described.

22 Claims, 12 Drawing Sheets

DEVICE FOR STIFFENING A GOLF CLUB SHAFT

TECHNICAL FIELD

The present disclosure relates to golf clubs and golf club shaft stiffening devices. Particular example aspects of this disclosure relate to golf clubs with a stiffening strip applied to the golf club shaft which affects the flexibility and stiffness characteristics of the golf club shaft.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, some players continue to experience difficulties in reliably hitting a golf ball in an intended and desired direction and/or with an intended and desired flight path. Accordingly, there is room in the art for further advances in golf club technology.

SUMMARY OF THE DISCLOSURE

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Aspects of this disclosure relate to a device for stiffening a golf club shaft which includes a strip of material configured to engage the exterior of the golf club shaft. The longitudinal axis of the strip may be configured to extend in a direction parallel to a longitudinal axis of the golf club shaft when the strip engages the golf club shaft. The strip may be configured to increase the stiffness of a portion of the golf club shaft when the strip engages the portion of the golf club shaft. The strip may include longitudinal fibers configured to extend in a direction parallel to a longitudinal axis of the golf club shaft when the strip is engaged to the exterior of the golf club shaft.

Additional aspects of this disclosure relate to a golf club shaft kit which includes a golf club shaft and a strip of material configured to engage to the exterior of the golf club shaft. The longitudinal axis of the strip is configured to extend in a direction parallel to a longitudinal axis of the golf club shaft when the strip engages the golf club shaft. Further, the strip is configured to increase the stiffness of a portion of the golf club shaft when the strip engages the portion of the golf club shaft.

Additional aspects of this disclosure relate to a method for fitting a shaft of a golf club with a stiffening strip. The method includes determining a stiffness characteristic of the shaft of the golf club and determining a desired stiffness characteristic of the shaft based upon a swing of the golf club using a measuring device. The method further includes selecting a particular stiffening strip from a plurality of available stiffening strips based upon the determined desired stiffness characteristic and engaging the selected stiffening strip to the golf club shaft wherein a longitudinal axis of the stiffening strip extends in a direction parallel to a longitudinal axis of the golf club shaft when the stiffening strip is engaged to the golf club shaft. The method further includes positioning the particular stiffening strip on the golf club shaft at a particular position on the shaft that will provide the desired stiffness characteristic.

BRIEF DESCRIPTION OF THE DRAWINGS

The present invention is illustrated by way of example and not limited in the accompanying figures, in which like reference numerals indicate similar elements throughout, and in which.

Figure 1:
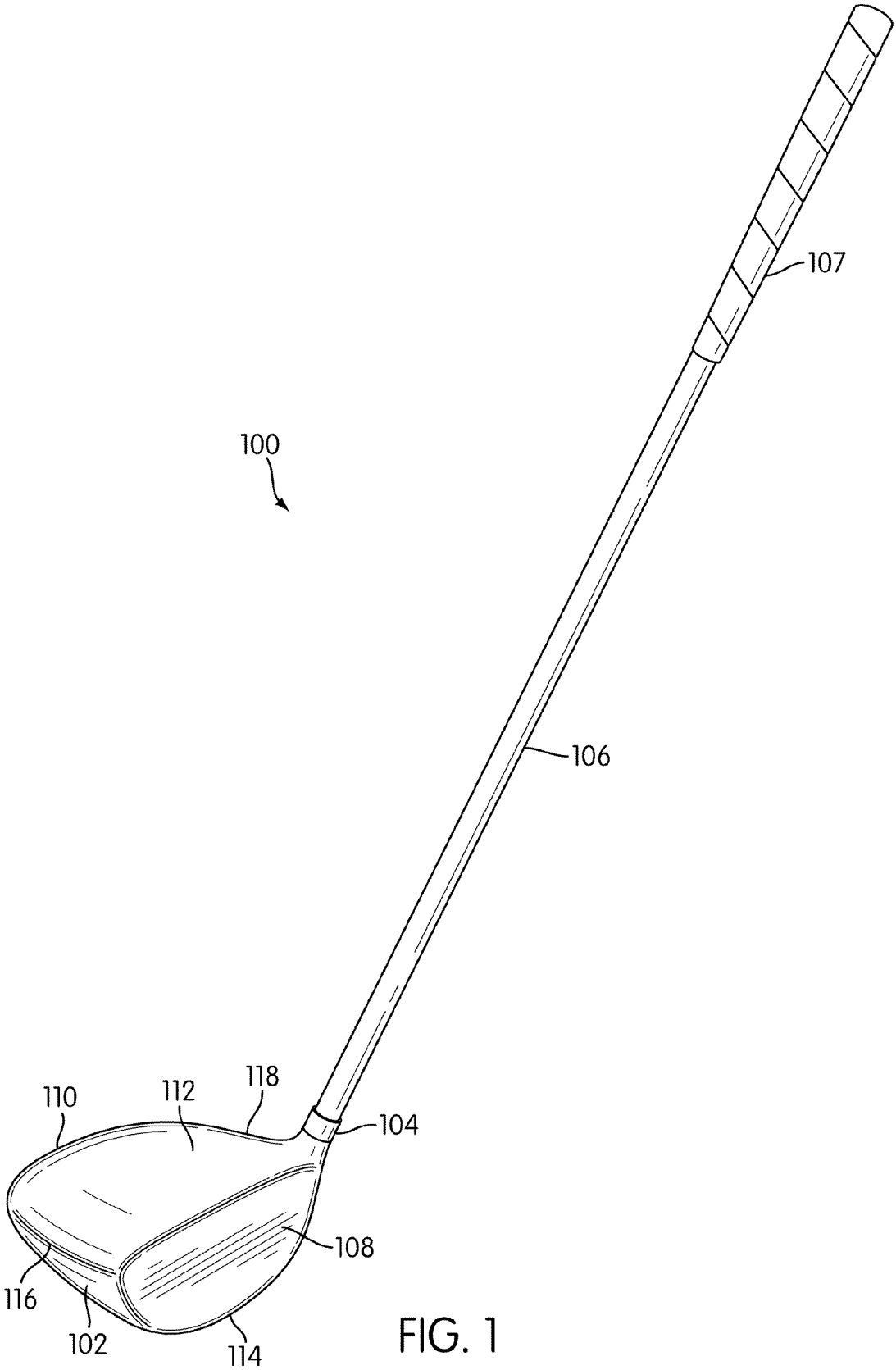
FIG. 1 generally illustrates a golf club structure according to at least some examples of this disclosure.

The reader is advised that the various parts shown in these drawings are not necessarily drawn to scale.

DETAILED DESCRIPTION

The following description and the accompanying figures disclose features of golf clubs and golf club shaft stiffening devices in accordance with examples of the present disclosure.

I. General Description of Example Golf Clubs, Golf Club Shaft Stiffening Devices and Methods in Accordance with this Disclosure As described above, some players experience difficulty in reliably hitting a golf ball in an intended and desired direction and/or with an intended and desired flight path. Therefore, aspects of the disclosure are directed to golf clubs configured to aid a player in reliably hitting the ball in an intended and desired direction and/or with an intended and desired flight path. Particular aspects of the disclosure are directed to golf club shafts wherein a device is applied to the shaft to affect the stiffness and flexibility characteristics of the shaft. According to some aspects of the disclosure, the increased stiffness of the golf club shaft aids the golf club in imparting a particular trajectory and/or spin to a golf ball when the golf club head strikes the golf ball.

The shaft member of a golf club exhibits several characteristics including "flex", "stiffness", a "kick point", etc. The term "flex" refers to the amount of flexibility (i.e., bend) that a golf club shaft exhibits. The term "stiffness" refers to the amount of deflection that occurs in a shaft when a given tangential force is applied to the golf club head. The term "kick point" (also known as the flex point or bend point) refers to the point of the golf club shaft where the golf club shaft exhibits the greatest amount of flex. Such characteristics of the golf club shaft will affect the trajectory and distance of a golf ball struck by the golf club.

For example, flex affects the trajectory and distance of a golf shot and should be considered when determining the type of shaft that a particular golfer requires to achieve optimal performance from the golf club. Further, the optimal amount of flex for a particular golfer is directly related to characteristics of a particular golfer's swing. For example, a golfer's swing tempo (i.e., the elapsed time of a golfer's swing) and the golfer's swing speed (i.e., the club head's speed at impact) are two factors in determining the optimal amount of flex for a particular golfer. Generally, if a golfer's swing speed and tempo are fast, the golfer will need a stiffer shaft to achieve optimal performance from the golf club. Conversely, if the golfer's swing speed and tempo are slower, the golfer will need a less stiff shaft to achieve optimal performance from the golf club.

Similarly to the flex characteristic of a golf club shaft, the position of the kick point along the length of the golf club shaft affects the trajectory and distance of a golf shot. The position of the kick point of a shaft will often affect the orientation of the golf club head when the golf club head strikes the golf ball. If the flex and stiffness of the shaft and the kick point are not customized to a particular golfer's swing characteristics, then the performance of the golf club as it relates to that the particular golfer might not be optimized.

A golf club shaft can be manufactured to provide the shaft with a particular amount of flex. For example, the flex of a shaft is usually designated by one of five letters from (most flexible to least): L (ladies), A (senior or amateur), R (regular), S (stiff), and X (extra stiff). Similarly, the golf club shaft can be manufactured to provide the kick point in a particular position on the shaft. For example, the golf club shaft can be tapered and/or the thickness of the golf club shaft can be decreased or increased at particular locations (e.g., to provide nodes). However, regardless of how the golf club shaft is created during manufacture, once the shafts have been manufactured (e.g., with a predetermined flex, stiffness and kick point), the golf club shaft's characteristics are not readily variable.

Therefore, aspects of this invention relate to a device that allows for characteristics of the golf club shaft to be varied quickly and easily. For example, according to particular aspects of the disclosure, the characteristics of the golf club shaft, such as the flex, stiffness and kick point of the shaft, may be adjusted quickly and easily and without modifying the structure of the shaft itself. Further, particular aspects of the disclosure are directed to stiffening strips of material engaged with the shaft of golf clubs to affect the stiffness and flexibility characteristics of the shaft. For example, according to aspects of this disclosure, the stiffening strip of material is a tape which contains longitudinal fibers and the tape is applied such that the longitudinal fibers extend along the longitudinal axis of the shaft of the golf club.

Additional aspects of this disclosure relate to wood-type or iron-type golf club structures that include golf club shaft stiffening devices (e.g., of the types described above). Such golf club structures further may include one or more of: a golf club head (e.g., a wood-type or iron-type golf club heads); a golf club shaft attached to the golf club head; a separate hosel member or a hosel member provided as an integral part of one or more of the club head or shaft; a grip or handle member attached to the shaft; etc.

Additional aspects of this disclosure relate to methods for producing iron or wood-type golf club structures in accordance with examples of this disclosure. Such methods may include, for example, one or more of the following steps in any desired order and/or combinations: (a) providing a golf club shaft stiffening device of the various types described above (including any or all of the various structures, features, and/or arrangements described below), e.g., by manufacturing or otherwise constructing the golf club shaft stiffening device, by obtaining it from a third party source, etc.; (b) engaging a shaft member with a golf club head (e.g., a wood-type or iron-type golf club head) at a separate hosel member or a hosel member provided as an integral part of one or more of the club head or shaft; (c) engaging a grip member with the shaft member; (d) engaging a golf club shaft stiffening device to the golf club shaft to affect the characteristics of the golf club shaft; etc.

Given the general description of various example aspects of the disclosure provided above, more detailed descriptions of various specific examples of golf clubs and golf club shaft stiffening devices according to the disclosure are provided below.

II. Detailed Description of Example Golf Clubs, Golf Club Stiffening Devices and Methods According to the Disclosure The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

An illustrative embodiment according to one or more aspects of the disclosure is shown in FIG. 1. FIG. 1 generally illustrates an example of a wood-type golf club 100 in accordance with the disclosure. As seen in FIG. 1, the golf club includes a club head body 102. The club head body 102 may be constructed in any suitable or desired manner and/or from any suitable or desired materials without departing from this disclosure, including from conventional materials and/or in conventional manners known and used in the art. For example, the club head body 102 may include a ball striking face portion 108 (including a ball striking face plate integrally formed with the ball striking face portion or attached to a frame member such that the face plate and frame portion together constitute the overall ball striking face portion). Additionally, the club head body 102 may include a rear portion 110 opposite the ball striking face, a crown (or top) portion 112, a sole portion 114, a toe end portion 116 and a heel end portion 118. According to some aspects of the disclosure, the dimensions of the golf club head body may include a volume between 200-500 cubic centimeters.

Wide varieties of overall club head constructions are possible without departing from this disclosure. For example, if desired, some or all of the various individual parts of the club head body 102 described above may be made from multiple pieces that are connected together (e.g., by adhesives or cements; by welding, soldering, brazing, or other fusing techniques; by mechanical connectors; etc.). The various parts (e.g., top portion, sole portion, crown member, etc.) may be made from any desired materials and combinations of different materials, including materials that are conventionally known and used in the art, such as metal materials, including lightweight metal materials (e.g., titanium, titanium alloys, aluminum, aluminum alloys, magnesium, magnesium alloys, etc., composite materials, polymer materials, etc.). The club head body 102 and/or its various parts may be made by forging, casting, molding, and/or using other techniques and processes, including techniques and processes that are conventional and known in the art.

Further, for golf club structures according to this disclosure, the overall golf club structure (wood or iron) may include a hosel region, a golf club shaft received in and/or inserted into and/or through the hosel region, and a grip or handle member attached to the golf club shaft. For example, as seen in FIG. 1, the golf club 100 includes a hosel region 104, a golf club shaft 106 and a grip or handle member 107. The portions of the golf club 100 including club head 102, hosel 104, shaft member 106 and grip 107 can be configured and engaged in manners such as described below.

Optionally, if desired, the external hosel region 104 may be eliminated and the golf club shaft 106 may be directly inserted into and/or otherwise attached to the head member 102 (e.g., through an opening provided in the top of the club head, through an internal hosel member (e.g., provided within an interior chamber defined by the club head), etc.). The hosel member 104 may be integrally formed as part of the club head structure, or it may be separately formed and engaged therewith (e.g., by adhesives or cements; by welding, brazing, soldering, or other fusing techniques; by mechanical connectors; etc.). Conventional hosels and their inclusion in an iron or wood-type club head structure may be used without departing from this disclosure.

Also, the grip or handle member 107 may be attached to, engaged with, and/or extend from the golf club shaft 106 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member 107 may be integrally formed as a unitary, one-piece construction with the golf club shaft. Additionally, any desired grip or handle member materials may be used without departing from this disclosure, including, for example: rubber materials, leather materials, rubber or other materials including cord or other fabric material embedded therein, polymeric materials, cork materials, and the like.

The golf club shaft 106 may be received in, engaged with, and/or attached to the club head body 102 in any suitable or desired manner, including in conventional manners known and used in the art, without departing from the disclosure. As more specific examples, the golf club shaft 106 may be engaged with the club head body 102 via a hosel member 104 and/or directly to the club head body 102, e.g., via adhesives, cements, welding, soldering, mechanical connectors (such as threads, retaining elements, or the like), etc.; through a shaft-receiving sleeve or element extending into the club head body 102; etc. If desired, the golf club shaft 106 may be connected to the club head body 102 in a releasable manner using mechanical connectors to allow easy interchange of one shaft for another on the head.

The golf club shaft 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. For example, according to some aspects of this disclosure, the shaft 106 may be composed of either steel or graphite. Steel shafts generally are heavier and have a lower torque rating than graphite shafts. Steel is generally more durable and resistant to damage than graphite. Conversely, graphite is generally lighter and has a higher torque rating and torque range available to choose from depending on the particular graphite selected. Graphite shafts often have three layers of wound fiber which provides increased rigidity and performance.

Shaft 106 may be varied in length, material composition, stiffness, flex and other traits and features. For example, shaft 106 may vary in its particular dimensioning especially its length but also in other characteristics such as diameter. The shaft 106 may be a tapered tube. In one configuration the shaft 106 has a diameter of approximately 0.5 inch near the grip and continuously tapers down the length of the shaft 106 until the end opposite the grip 107 will generally be at its narrowest with a diameter smaller than the diameter near the grip (e.g., less than 0.5 inches).

As briefly discussed above, golf club shafts with different characteristics, such as flex, stiffness, and positioning of a kick point, etc., will affect the golf club's performance as it relates to a particular golfer with a particular swing. For example, an illustrative demonstration of varied shaft stiffness between two golf clubs substantially identical except for different shafts may be performed by clamping an end of the golf club opposite the golf club head so as to hold the golf club in a fixed immobile position capable of supporting a weight. Then a given weight may be hung from the end of the golf club with the golf club head. In particular, the weight may be applied to or hung from a front surface of the golf club head. With one end being clamped securely and a weight hanging from the opposing end of the golf club, the golf club will form a cantilever member. However, the shaft will not remain rigid but instead will exhibit a bend that increases as one moves closer and closer to the location at which the weight is hung from the golf club such that the golf club head may be described as bowing much as a fishing rod bows when a force is applied to an end opposite the end in which the user is firmly gripping the fishing rod. Now, the same demonstration may be performed with the second golf club that is substantially identical except the shaft exhibits a stiffer shaft. Here, the second golf club used in the demonstration will not bow or bend to the same extent as the first golf club due to the increased stiffness characteristics of the shaft. Described from another perspective if two given shafts only vary in their stiffness, more force needs to be applied to the stiffer shaft to cause the shaft to deflect or bow to the same magnitude as the less stiff shaft.

The above illustrative demonstration may be associated with a golfer's swing. As the golfer begins a downswing, the golfer will begin bring their hands which are gripping the golf club at the grip and the shaft will exhibit a bend as the golf club head initially trails behind the golfer's hands at the beginning of the downswing. The golfer's hands are driving the shaft (and the golf club head at the opposing end of the shaft) around the golfer, but the shaft lags a bit. However, the shaft lag results in energy being stored in the shaft in the form of a bend in the shaft. Now, as the golfer continues the downswing, the shaft will continue to bend further to the extent its physical stiffness characteristics permit it to bend further. At a certain point the shaft will reach its maximum bend based upon its stiffness compared to the speed of the golfer's swing and then the shaft will begin to release its stored energy and begin to straighten out. In certain instances it may be preferred for the shaft to reach its maximum bend as a golfer's left elbow begins to straighten out (assuming a right handed golfer). As mentioned above, at this point, the shaft will begin to straighten out thereby causing the golf club head to increase in velocity. As is recognized, increased club head velocity at the time the club head impacts the golf ball will directly result in the golf ball having an increased initial velocity which will cause the ball to generally travel farther, as is often desirable in the game of golf. In order to maximize or optimize the velocity of the golf club head at the time of impact of the ball striking face, the shaft can be configured or chosen so that it will finish straightening out simultaneously with impact of the golf club head with the golf ball. Generally, the golf club head will be moving at a maximum velocity of the swing simultaneously with the shaft straightening as all of the energy stored as potential energy in the bend is released. However, if the golf club head (and shaft) continues to travel for a certain distance/time after the shaft straightens out before the golf club head impacts the golf ball, energy will be lost as energy begins to be stored by the shaft bending again but in the opposite direction as during the initial downswing. Accordingly, it is desirable for the shaft to consistently straighten as the golf club head impacts the golf ball.

Thus a golfer may desire to have a golf club with a shaft that will straighten out at the moment of impact to optimize the force that their swing is generating and accordingly will maximize the distance the golf ball travels. Accordingly, the golf club head will be moving as fast as possible for the given golfer's swing etc. Therefore, a shaft will often be chosen to accomplish the optimized timing and straightening out of the shaft as described depending on the golfer's swing characteristics. For example, if a golfer has a very fast swing but has a golf club with a supple shaft, the golfer's shots will not travel as far as they possibly could be travelling if the golfer was optimizing his swing energy because the shaft has absorbed energy in the form of a bend in the shaft and will not have fully released what it previously stored at the moment of impact and golf club head velocity at impact will not have been maximized. Swing energy will have been wasted and the resulting shot will not achieve maximum travel distance. On the other hand, if a golfer has a slow swing but selects a very shift staff, a similar shot inefficiency and failure to maximize swing energy will result but for the opposite reason. In this instance the shaft will straighten out while the golfer is still in the downswing and the golf club head will travel ahead of the shaft such that the shaft is now bent forward. Again, the bent shaft at impact equates to wasted swing energy and a slower golf club head velocity at impact. Again, the golf ball's travel distance after impact will not be maximized. As such, it is desirable for a golfer to have a golf club that includes a shaft with stiffness characteristics complementary to the golfer's swing to maximize the golfer's swing and swing energy and optimize the golfer's shots.

Premature or tardy straightening of the club shaft may also cause the directional aspects of the golf shot to be significantly altered as the orientation and travel path that the golf club head takes as it travels through the hitting zone and contacts the golf ball can be varied. Accordingly, the golf ball may not be struck in a sweet spot of the hitting surface. For example, ideally, the ball striking face portion of the club head should be "square" (i.e., perfectly straight) at impact with the golf ball in order to achieve an accurate golf shot with the greatest amount of distance. However, as discussed above, throughout the golf swing the shaft flexes, and, as a result, the position of the club head changes. If the shaft does not have the complementary amount of flex for a particular golfer's swing, and the straightening of the club shaft is early or late, there is less chance that the particular golfer will make contact with the ball with a square clubface. In other words, having the "wrong" amount of flex for a particular golfer may cause the ball striking face to be misaligned at impact, which will result in golf shots that are off-target and have unintended trajectories.

For example, the golf ball may take an initial direction path askew from the desired path of travel. Spin may also be placed on the ball so as to inadvertently cause the golf ball to travel with a "hook" or "slice" path of travel. Further, the struck golf ball may not travel with an initial desired ball flight angle relative to the ground such that the ball is "popped up" or skulled and hit so as to skim the ground rather than travel with an elevated loft through the air such that the vast majority of the ball's travel distance occurs while the ball is traveling in the air rather than during rolling, bouncing or skimming the surface of the ground. Generally, if the shaft is too stiff for a particular golfer, then the golf ball's trajectory could be lower and shorter for any given loft, compared to a properly fit shaft. Further, the golf ball's trajectory may tend to follow a fade trajectory (i.e., to the right for right-handed golfers and to the left for left handed golfers) because with a shaft that is too stiff, the clubface is more difficult to square and, hence, the ball striking face is more likely to be open at impact. Conversely, if the shaft is not stiff enough for a particular golfer, then the golf ball's trajectory ball could be higher for any given loft, compared to a properly fit shaft. Further, the golf ball's trajectory may tend to follow a fade trajectory (i.e., left for a right-handed golfer and right for a left handed golfer) because with a shaft that is too flexible, the ball striking face may tend to be closed at impact.

Further, as briefly discussed above, golf club shafts with different kick points will also affect the golf club's performance as it relates to a particular golfer with a particular swing. Various shaft models may be designed to have a kick point at various respective locations along their length. In some instances a shaft may be generalized as having a low, mid or high kick point. The kick point of a shaft will often affect the orientation of the golf club head when the golf club head strikes the golf ball. Accordingly, the location of the kick point may vary shot tendencies. Therefore, a golfer may choose a golf club with a kick point in a particular location to complement his or her swing tendencies, swing speed and golf skill. Generally speaking, a shaft with a high kick point (near the grip end of the golf club) will typically produce lower launching golf shots. In contrast, a golf club shaft with a low kick point (near the club head end of the golf club) will typically produce higher launching golf shots.

Figure 2A:
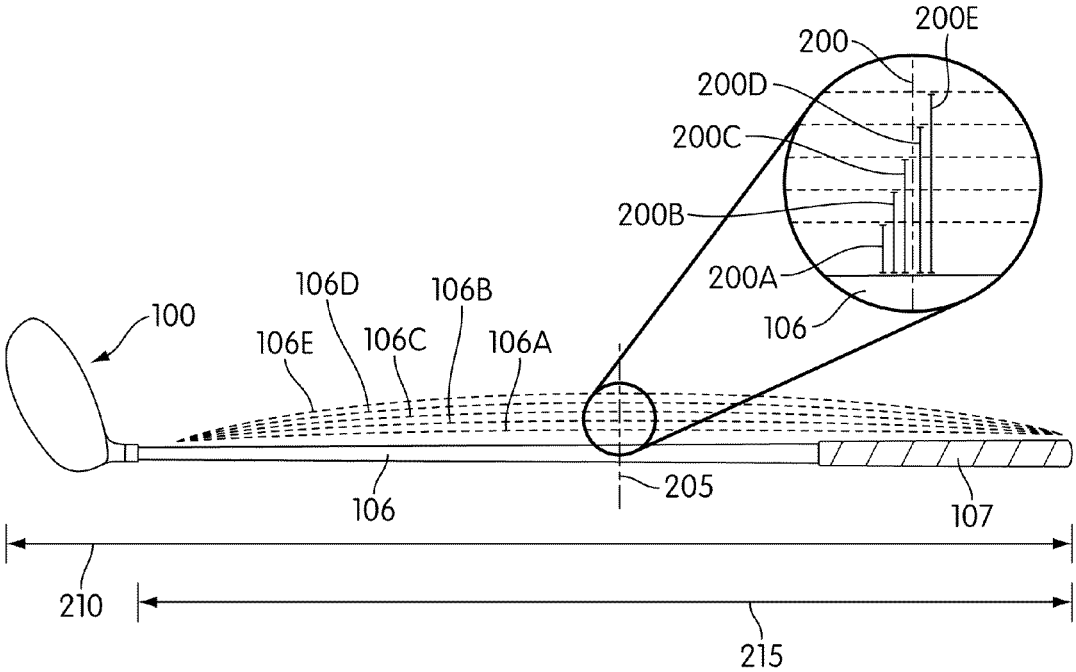
FIGS. 2A-2B are illustrative diagrams depicting characteristics, including shaft characteristics of a golf club.
Figure 2B:
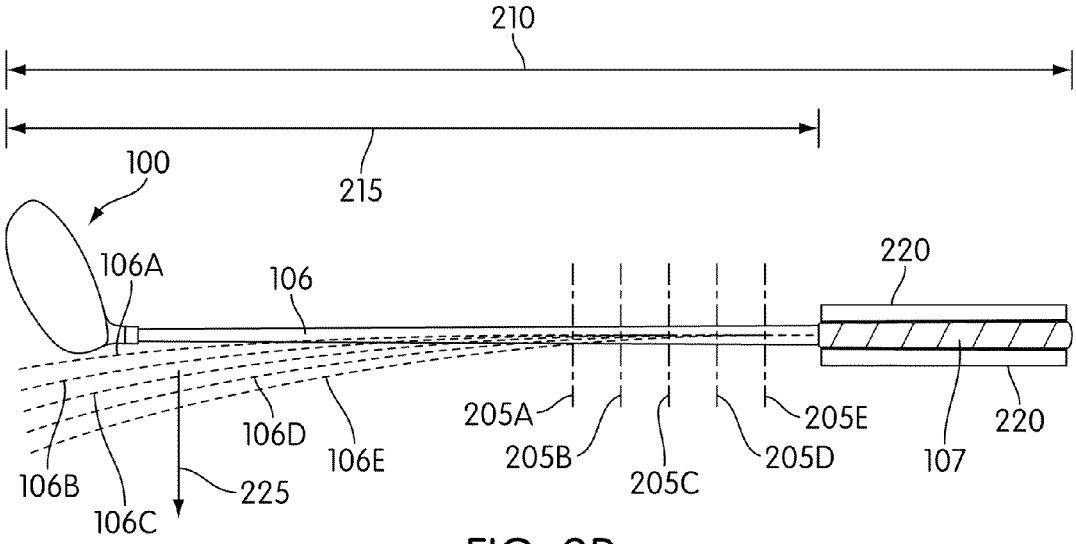

FIGS. 2A-2B are illustrative diagrams of golf club 100 demonstrating varied shaft stiffness and kick points of a golf club. FIG. 2A illustrates the flex characteristics of a golf club configured with 5 different stiffness characteristics consistent with the principles discussed above. As such, the golf club 100 and in particular the shafts 106A-E may exhibit a state of maximum flex as shown and will be orientated with each arrangement of the golf club 100 to have a respective maximum flex 200A-E associated with the five respective shafts 106A-E of varied stiffness. For example, the shafts 106A-E may illustratively be shown in the state of maximum flex and may be illustratively described as Extra Stiff Shaft 106A, Stiff Shaft 106B, Regular Shaft 106C, Senior Shaft 106D, and Ladies Shaft 106E. These designations are again illustrative and for ease of understanding and clarity, however, they may vary greatly. For example, in another arrangement the same five shafts 106A-E illustrated in maximum flex state may all be characterized or labeled as "Regular" shafts and may have varied specific stiffness characteristics despite all being characterized as "Regular" shafts. Shaft 106A may be characterized as the stiffest shaft, shaft 106E as the least stiff and shafts 106B-D falling in line accordingly in between shafts 106A and 106E with respect to stiffness. Also, shown in FIG. 2A is a flex length 215 which is equivalent in this arrangement to the length of the shaft 106 of the golf club (including the grip 107) which may be flexed when force is applied to the golf club 100. Also, the golf club 100 and each of the five arrangement of the golf club 100 with varied shafts 106A-E are shown as having the same kick point, denoted symbolically by reference numeral 205, where the shaft 106 bends as shown. While these shafts 106A-E have a common kick point 205, varied locations of kick points 205 between shafts 106A-E with varied stiffness is contemplated and will be described in further detail later.

FIG. 2B further illustrates the effects of a golf club shaft for a given golf club 100 having a varied stiffness. FIG. 2B illustratively depicts golf club 100 clamped at the grip end 107 of the golf club 100. The clamp 220 (which may be equated to a golfer's grip) securely holds the grip 107 and the portion of the shaft 106 housed within the grip in a rigid fixed position. As such the region of the shaft housing the grip 107 and held in the clamp does not exhibit flex or bending when a force in the form of a weight 225 hung from the opposing club head 102 end is applied. The golf club 100 is again shown with a series of five shafts 106A-106E shown in a flexed state as a result of the force in the form of weight 225 being applied as described. Here, because the grip end 107 of the golf club is clamped and does not exhibit flex or bending, the flex length 215 and the actual length of the shaft are different. As such, the flex length 215 of the golf club 100 illustratively shown in FIG. 2B is the length 210 running from one end of the grip 107 to the opposite end of the shaft 106 at the golf club head 102.

Variances in the behavior of the golf club 100 between arrangements of varied shafts 106A-E with varied stiffness are shown. Again, shaft 106A is the stiffest shaft while shaft 106E is least stiff with the other shafts shown falling accordingly and respectively in line. As is apparent from FIG. 2B, the stiffer the shaft 106 is the less deflection or bending the shaft 106 exhibits when a given force 225 is applied at a given location. Further, the illustrative diagram of FIG. 2B illustrates that the location of a kick point 205 may be varied as well between shafts 106A-E with varied stiffness. Here, shaft 106A has the lowest kick point 205A, shaft 106E has the highest kick point 205E, and shafts 106B-D have associated kick points 205B-D falling in between. In this instance the variance in particular location of kick point 205 location is minimal as compared to the respective lengths of the flex length 215 and length 210 of the golf club 100. A given golf club shaft 106A-E may be made with a certain given stiffness characteristic and kick point 205A-E. However, it may be preferred for the stiffness of the shaft 106 to be varied, or the location of the kick point 205 be varied. Further, it may be desirable to vary the stiffness of only a portion of the shaft 106 while maintaining the original stiffness of the remainder of the shaft 106. For example, by stiffening a portion of the shaft 106 but allowing the remainder of the shaft to continue to exhibit the original stiffness characteristic, more customized stiffness, kick point and related characteristics may be achieved as desired. For example, overall stiffness may be varied, and/or the locale of the kick point 205 may be transitioned. Specifically, the kick point 205 may be shifted either further up the shaft 106 towards the grip 107 such that the kick point 205 is higher and the golf club 100 has a tendency to provide higher launching trajectory/ball flight when the golf club 100 is used or further down the shaft 106 such that the golf club 100 has a tendency to provide a lower launching trajectory/ball flight. By varying the stiffness of the shaft 106 in certain regions, the kick point 205 may be resultantly shifted as well as the flex length 215 of the shaft 106 may be varied thereby causing the location at which bend occurs to be varied.

Therefore, it is understood that a golf club shaft's characteristics of flex, stiffness, kick points, etc. will affect a golf club's performance as it relates to a particular golfer and his particular swing characteristics. Further, it is also understood that it would be beneficial to determine flex, stiffness and kick points that are best suited to a particular golfer and to customize a golf club shaft to provide such characteristics in order to optimize the performance of the golf club for that particular golfer.

Figure 3A:
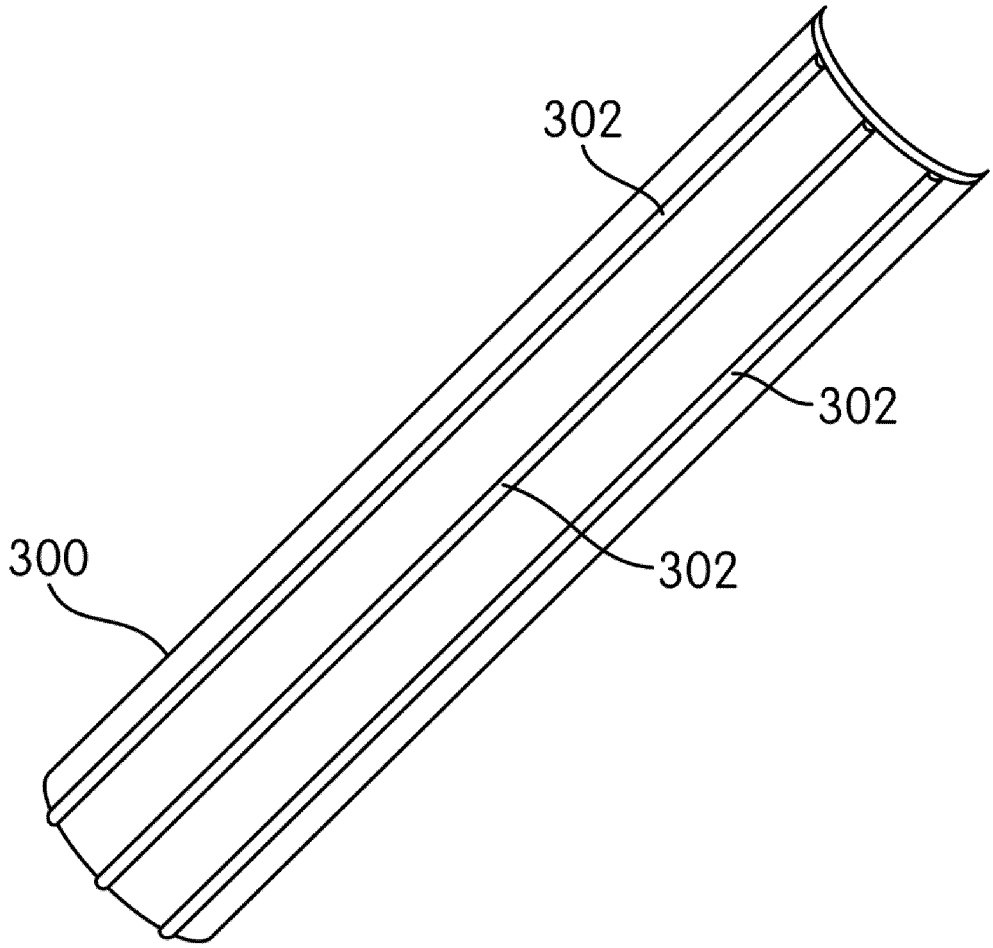
FIG. 3A is a perspective view of an illustrative embodiment of a stiffening strip according to aspects of this disclosure.

FIG. 3A is an illustrative embodiment of a stiffening device according to aspects of this disclosure. The stiffening device 300 is configured to be engaged with the golf club shaft to customize the shaft's characteristics to optimize the performance of the golf club for the particular golfer. As seen in FIG. 3A, the stiffening device 300 is in the form of a strip. The stiffening strip 300 is engaged with exterior of the golf club shaft 106 to affect, adjust and/or control characteristics of golf club shaft 106 including the flexibility, stiffness and positioning of the kick points 205. For example, the stiffening strip 300 can be configured to increase the stiffness of a portion of the golf club shaft 106 when the stiffening strip 300 engages the portion of the golf club shaft 106, but still allows the golf club shaft 106 to retain its original characteristics, such as flex, in the other locations of the golf club shaft 106.

According to some aspects of this disclosure, the stiffening strip 300 is a material that is relatively rigid and stiff. Therefore, according to some aspects of this disclosure, the stiffening strip 300 acts as a brace to stiffen the portion to the golf club shaft 106 to which the stiffening strip 300 is attached. Example materials of the relatively rigid and stiff material include: rigidified fiber mesh, plastics, thermo plastics, precured carbon, rubber, polymers, polymeric materials, metals, and other materials, etc.

According to particular aspects of this disclosure, the stiffening strip 300 can include longitudinal fibers 302 that increase rigidity and stiffness of the stiffening strip 300. Providing the fibers 302 in a longitudinal direction along the longitudinal axis of the stiffening strip 300 allows the fibers 302 to provide tensional strength and rigidity to the stiffening strip 300. According to some embodiments of the disclosure, fibers 302 may be provided at an angle to the longitudinal axis of the stiffening strip 300 (e.g., from 1° to 90° relative to the longitudinal axis of the stiffening strip 300). Additionally, according to some embodiments of the disclosure, fibers 302 may be provided at different angles from each other and overlap each other (e.g., a first set of one or more fibers may be provided at 30° relative to the longitudinal axis of the stiffening strip 300 and another set of one or more fibers may be provided at 90° relative to the longitudinal axis of the stiffening strip 300). Providing the fibers 302 in such a fashion allows the fibers 302 to provide increased tensional strength and rigidity to the stiffening strip 300. Example materials that are used as the longitudinal fibers 302 include: rigidified fibers, plastics, thermo plastics, pre-cured carbon, rubber, polymers, polymeric materials, metals, and other materials, etc. According to other embodiments of the disclosure, the stiffening strip 300 may be relatively flexible, while the longitudinal fibers 302 actually provide the rigidity and stiffness to the stiffening strip 300.

Figure 3B:
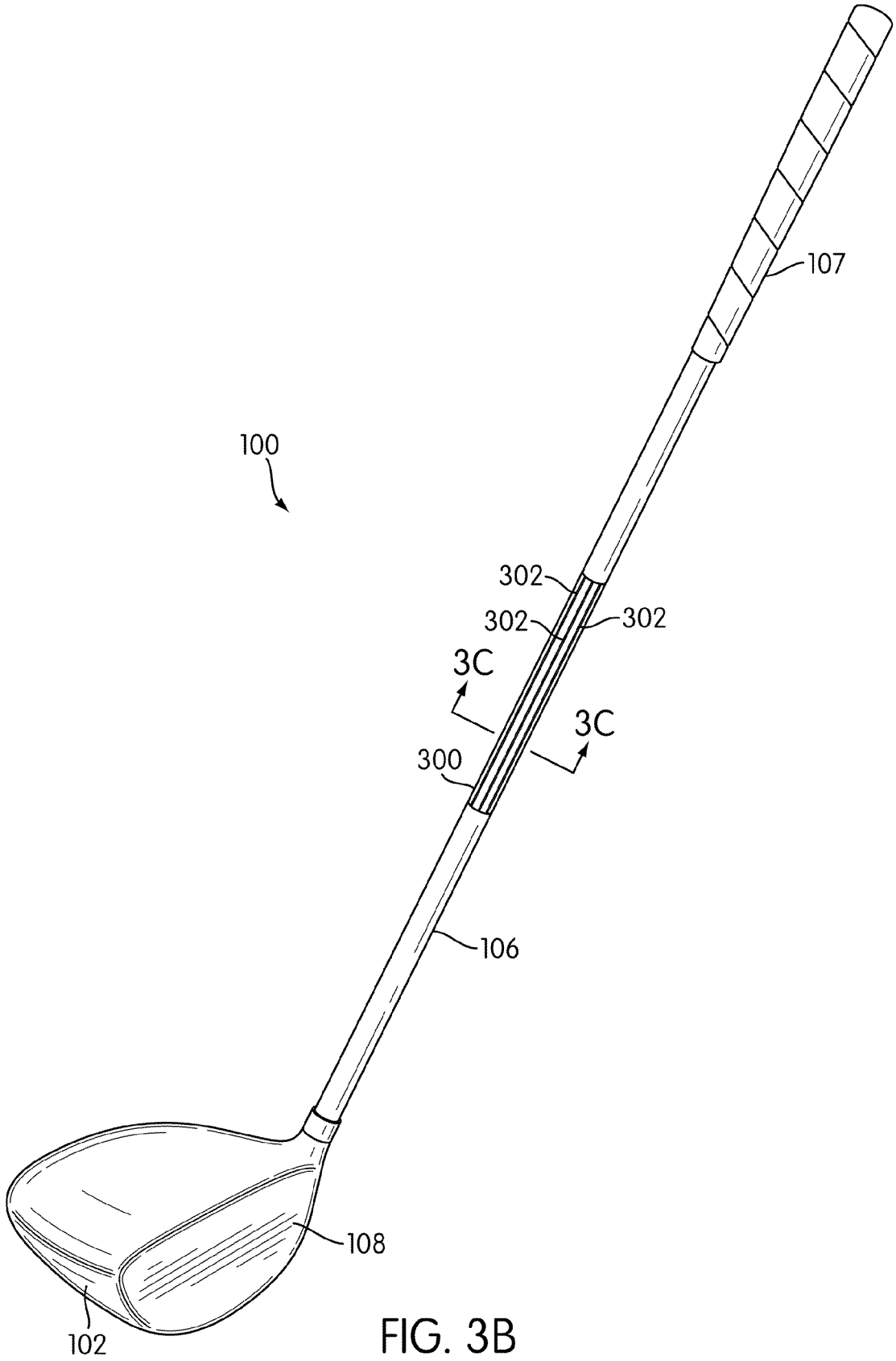
FIG. 3B is a perspective view of a golf club structure with a golf club shaft to which the stiffening strip of FIG. 3A has been engaged.

As seen in FIG. 3B, the stiffening strip 300 may be engaged with the golf club shaft 106. When the stiffening strip 300 is engaged with the golf club shaft 106, the stiffness of the portion of the golf club shaft 106 to which the stiffening strip 300 is engaged is increased. As seen in FIG. 3B, the stiffening strip 300 may be engaged with the golf club shaft 106 such that a longitudinal axis of the stiffening strip 300 extends in a direction parallel to a longitudinal axis of the golf club shaft 106. In other words, once the stiffening strip 300 engages the golf club shaft 106, the longitudinal axis of the stiffening strip 300 (including the longitudinal axis of the longitudinal fibers 302) extends along the length of the golf club shaft 106.

Figure 3C:
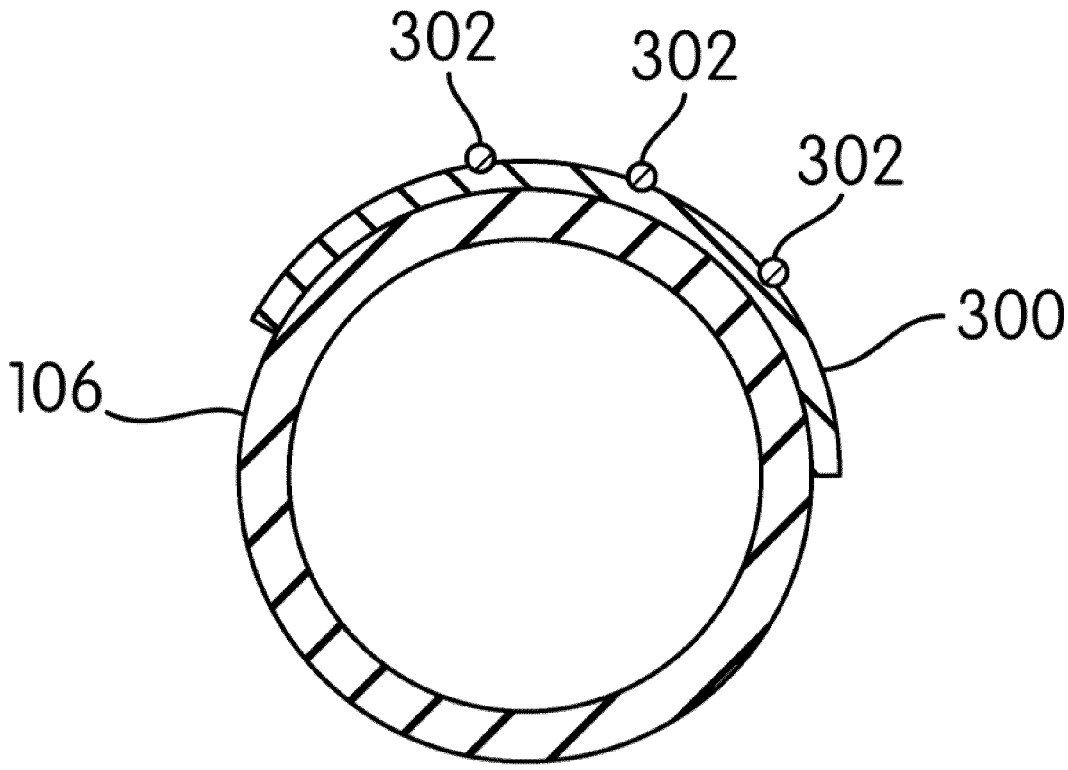
FIG. 3C is a cross-sectional view of the golf club shaft and attached stiffening strip shown in FIG. 3B.

FIG. 3C is a cross-sectional view of the golf club shaft 106 with the stiffening strip 300 attached thereto. As seen in FIG. 3C, the stiffening strip 300 does not extend around the entire circumference of the golf club shaft 106. Instead, the stiffening strip 300 extends around a portion of the circumference of the golf club shaft 106 that is less than the entire circumference of the golf club shaft 106. Of course, if the golfer desired to have the entire circumference of the golf club shaft 106 surrounded, more than one stiffening strips 300 could be applied to the golf club shaft 106. Further, according to other embodiments of this disclosure, the stiffening strip 300 could be created with such a width that the stiffening strip 300 would surround the entire circumference of the golf club shaft 106. Further, it is noted that multiple stiffening strips 300 could be overlain upon each other to provide even further rigidity and increase the stiffness of the golf club shaft 106.

According to aspects of the disclosure, the width of the stiffening strip 300 could be between 1.0 and 0.1 inches; 0.8 and 0.20 inches; 0.5 and 0.25 inches. Further, the thickness of the stiffening strip 300 could be between 0.25 and 0.03125 inches; 0.125 and 0.0625 inches or less than 0.03125 inches.

According to some aspects of this invention, the stiffening strip 300 is a tape. For example, the stiffening strip 300 could be a flexible tape or a relatively rigid tape. If the stiffening strip is a relatively rigid tape, then the stiffening strip 300 may have a predetermined curvature that matches the curvature of the exterior of the golf club shaft 106 such that it engages with the exterior of the golf club shaft 106 in a continuous manner. If the stiffening strip 300 is a flexible tape, then when it is applied to the shaft 106, according to some aspects of the disclosure the stiffening strip 300 tape could be exposed to subsequent processes which would cause the tape to become more rigid. For example, the stiffening strip 300 tape could be exposed to temperature, moisture, etc. wherein the materials of the stiffening strip 300 would be hardened or made more rigid.

According to some aspects of this disclosure, the stiffening strip 300 includes an adhesive surface that allows it to be attached to the golf club shaft 106. For example, the stiffening strip 300 could include a back surface which contains an adhesive that would engage the exterior of the golf club shaft 106. The adhesive should be strong enough to secure the stiffening strip 300 to the exterior of the golf club shaft 106 throughout continuous use of the golf club including exposure to the elements, such as weather conditions, extreme temperatures, etc. However, according to particular aspects of the disclosure the stiffening strip 300 should be configured for removable engagement with the golf club shaft 106. In other words, according to such embodiments, the stiffening strip 300 is relatively easily disengaged from the golf club shaft 106. For example, with regard to the adhesive backing (e.g., adhesive surface) embodiment, the stiffening strip 300 could be relatively easily peeled off of the golf club shaft 106.

Such adhesive backing is not the only removably engageable method of securing the stiffening strip 300 to the golf club shaft 106. Instead, other methods of securing the stiffening strip 300 to the exterior of the golf club shaft in a releasable manner could be employed. For example, releasable mechanical connectors, a friction fit engagement, magnetic engagement, etc. could be used. Of course, while such removably engageable methods are considered within the scope of the disclosure, other more permanent methods of engagement are still contemplated within the scope of the disclosure. For example, welding, soldering, brazing, or other fusing techniques; non-releasable mechanical connectors; etc could be used.

The stiffening strip 300 can be varied to any length desired. For example, the stiffening strip 300 could extend the entire length of the golf club shaft 106 or, alternatively, extend less than half of the length of the golf club shaft or even shorter lengths of several inches or less. It is noted that if stiffening strip 300 is, in fact, a tape, adjusting the length of the strip 300 to the desired length would be relative quick and easy because the tape could be easily severed at the appropriate positions to provide the desired lengths.

Of course, the length of the stiffening strip 300 will be varied based on the desired purpose. Also, the positioning of the stiffening strip 300 along the length of the golf club shaft will be adjusted based on the desired purpose. For example, stiffening strip 300 may be configured (i.e., sized) to cause a kick point of the golf club shaft to be varied when the stiffening strip 300 is engaged at different points along the golf club shaft 106.

In light of the above discussion, it is understood that the above described stiffening strip 300 allows characteristics of the golf club shaft 106, such as flex, stiffness, positioning of the kick points, etc. to be readily adjusted and controlled. Further, it is understood that the stiffening strip 300 allows for such stiffness and flexibility characteristics of the golf club shaft 106 to be varied quickly and easily. For example, such characteristics of the golf club shaft 106 may be adjusted without modifying the structure of the golf club shaft 106 itself.

Therefore, the above described stiffening strip 300 allows for the golf club shaft to be easily customizable to a particular golfer. In other words, the characteristics of the golf club shaft 106, such as flex, stiffness, positioning of the kick points, etc. are readily adjusted and controlled to match the particular swing characteristics of a particular golfer and, thereby, provide optimal performance of the golf club shaft 106 and the golf club 100 as it relates to the particular golfer. Additionally, it is understood that the stiffening strips 300 allow for the above described characteristics of the golf club shaft 106 to be fine tuned to the particular golfer's swing. For example, according to aspects of the disclosure, the stiffening strip's 300 are readily variable in length (e.g., the tape can be cut to the desired length) and, further, easily engageable at any position along the length of the shaft 106 (e.g., the tape can be engaged to exterior of the golf club shaft 106). Therefore, the golfer no longer has to rely on common stock shafts provided by golf manufacturers. Instead, now, even if the common stock shaft's stiffness is generally correct for a particular golfer (e.g., a stiff (S) shaft for a golfer with a high swing speed and tempo), the stiffening strip 300 allows shaft to be further customized and fine tuned (e.g., be varying the stiffness of the shaft at various locations on the shaft, varying the position of the kick point, etc.). Also, if the golf club shaft's characteristics do not match the particular golfer's swing characteristics (e.g., if the golfer already has an existing club that is not the correct flex for that golfer's swing or if the golfer's swing has changed since he obtained the particular club), modifying the stiffness, kick point, etc. of the existing shaft with the stiffening strip 300 is a cost effective alternative to replacing the golf club itself of even just replacing the shaft of the golf club.

FIGS. 4A-4D are illustrative diagrams depicting an illustrative effect the shaft stiffening device 300 has on the golf club shaft and the flex, stiffness, and kick point attributes. For reference, the shaft of a golf club 106 may have a low section 400A, mid section 400B, and a high section 400C. The low section 400A as shown is the section of the shaft adjacent to the golf club head 102 (and hosel 104 to the extent the particular arrangement of the golf club 100 includes a hosel). The low section 400A is the portion of the shaft 106 that typically has the smallest circumference diameter especially when the shaft 106 is continuously tapered from the grip end to the club head end on the opposing end of the shaft 100. The high section 400C is the portion of the shaft 106 that is adjacent to the grip end of the golf club 100 while the mid section 400B is the section between the low section 400A and high section 400C. The shaft stiffening device 300 may be specifically configured and sized for one of the low section 400A, mid section 400B, or the high section 400C. The specific sizing allows the shaft stiffening device 300 to be more specifically tailored to each section 400A-C including length and circumference.

Figure 4A:
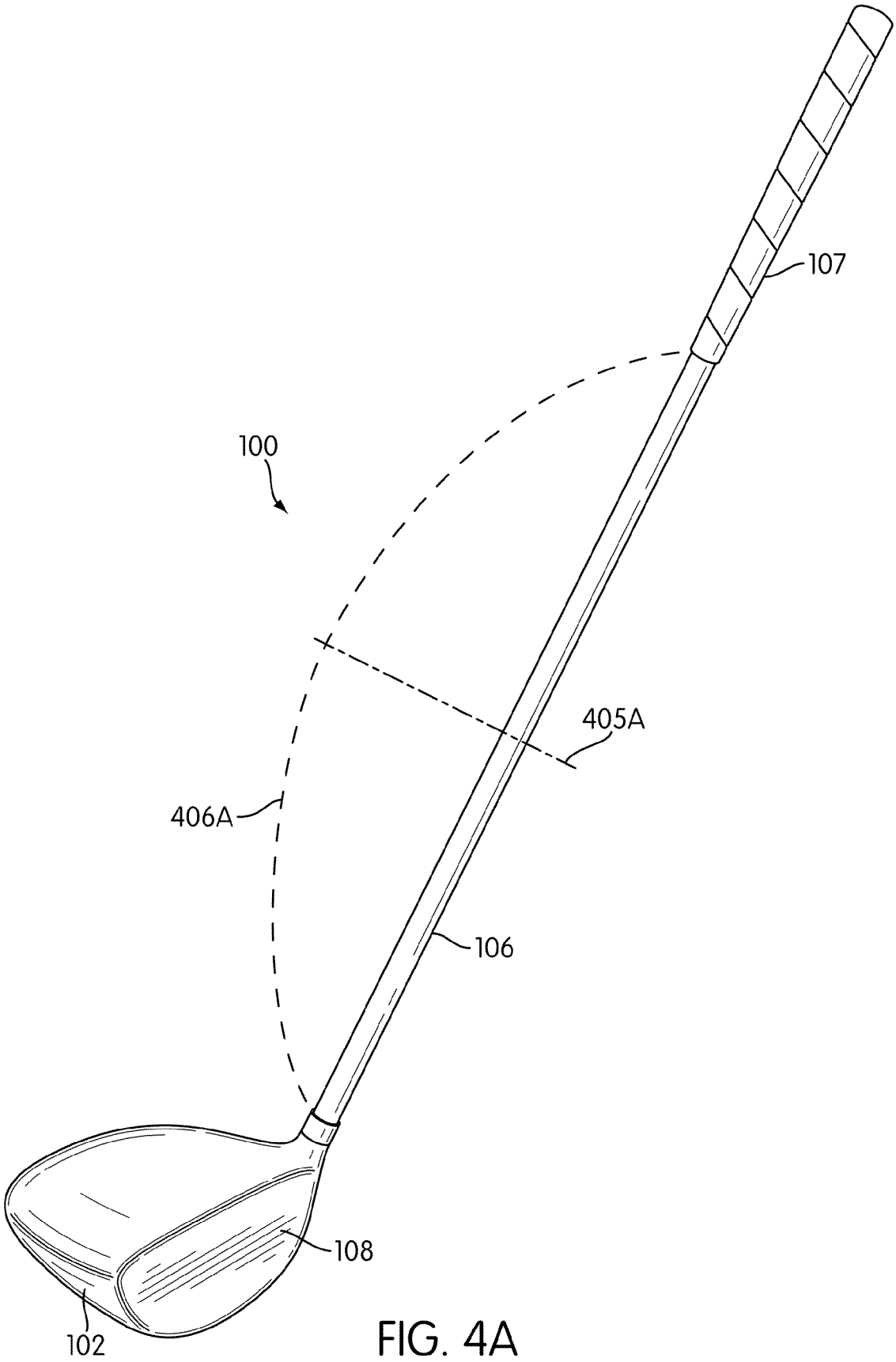
FIGS. 4A-4D are illustrative embodiments of a golf club to which a strip has been attached that diagrammatically depict illustrative effects of the stiffening strips on a golf club shaft.

FIG. 4A illustratively depicts a golf club 100 without any shaft stiffening device 300. Also, in FIG. 4A the golf club 100 has a flex length (as shown in its maximum state of flex, 406A) shown as extending from the golf club head 102 to the grip 107. Similar to how the portion of the shaft with the grip 107 did not demonstrate bend or flex in FIG. 2B, the grip 107 also will generally remain straight and rigid. In other words, similar to how the grip 107 was clamped in place and thus did not bend, the golfer will grip the golf club on the grip 107 and the golfer's hands will act as a securing force (like the clamp) preventing the shaft from bending at the grip 107. It should be understood and recognized that golfers may grip the shaft at varied positions on the grip 107 and thus the flex length 215 may actually include portions of the lower end of the grip 107, however, for illustration and explanation purposes FIGS. 4A-4D assume the grip 107 is held rigid by outside forces such as by a golfer's hands down the entire length of the grip 107.

Figure 4B:
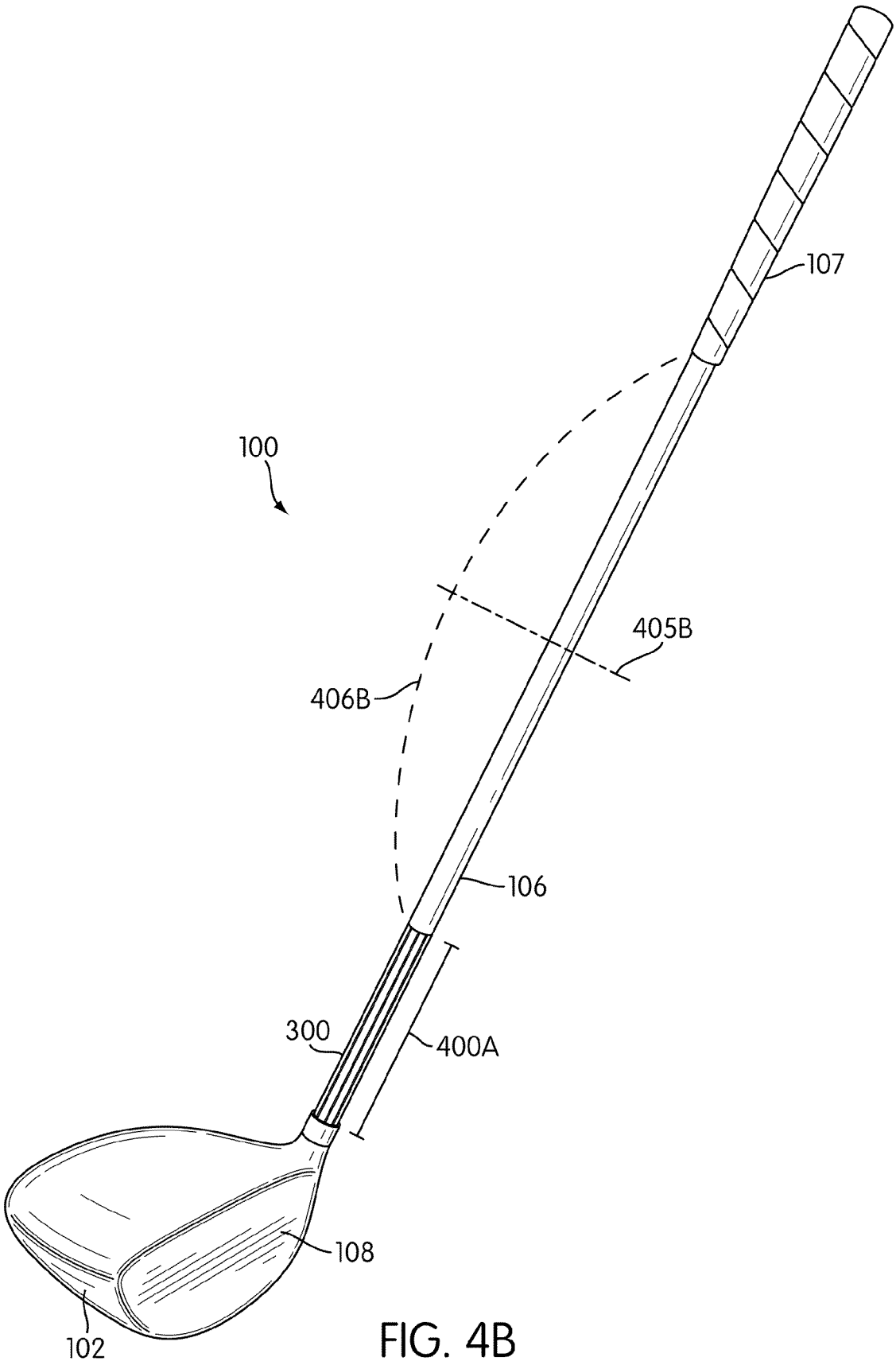
Figure 4C:
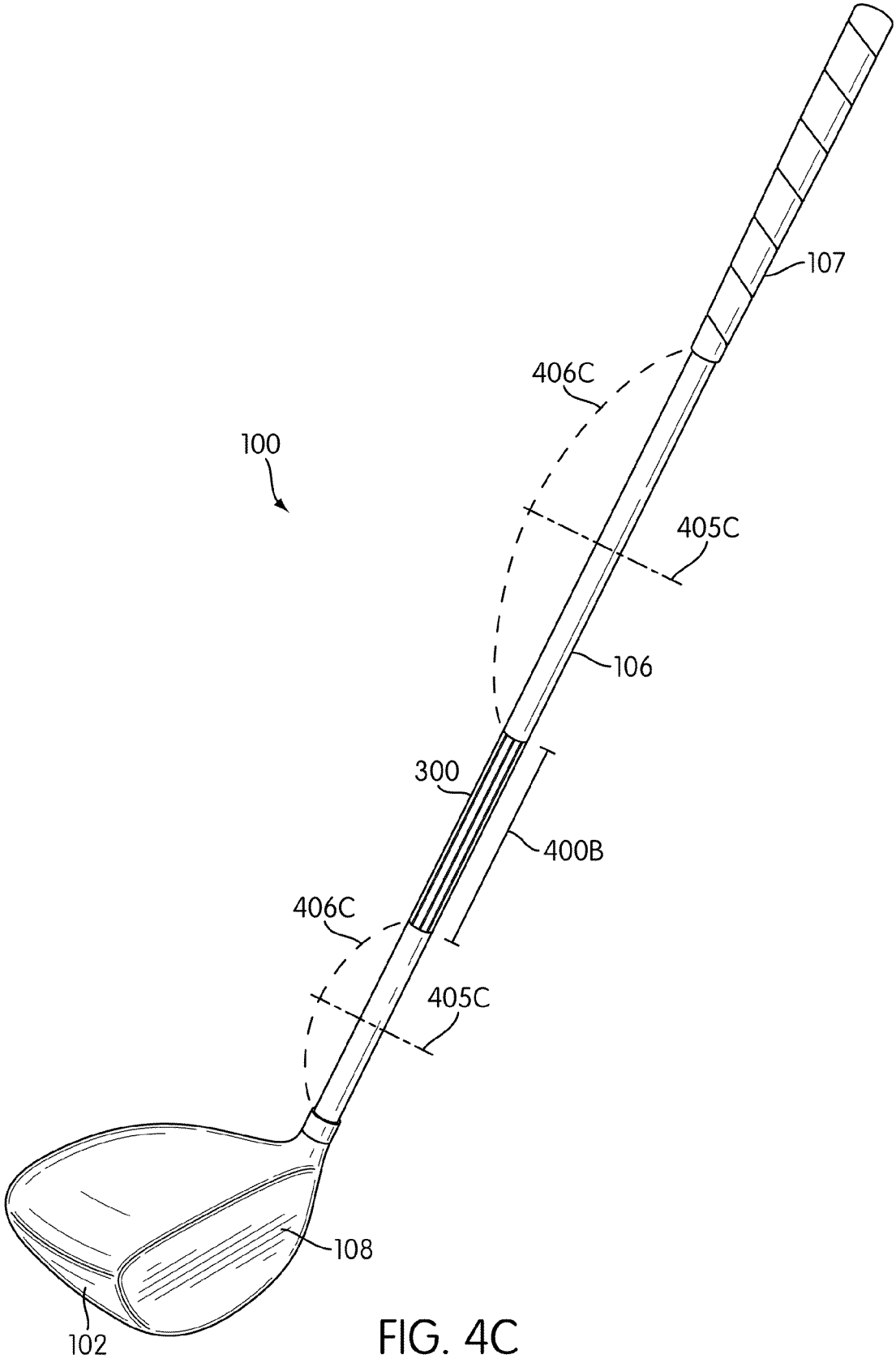
Figure 4D:
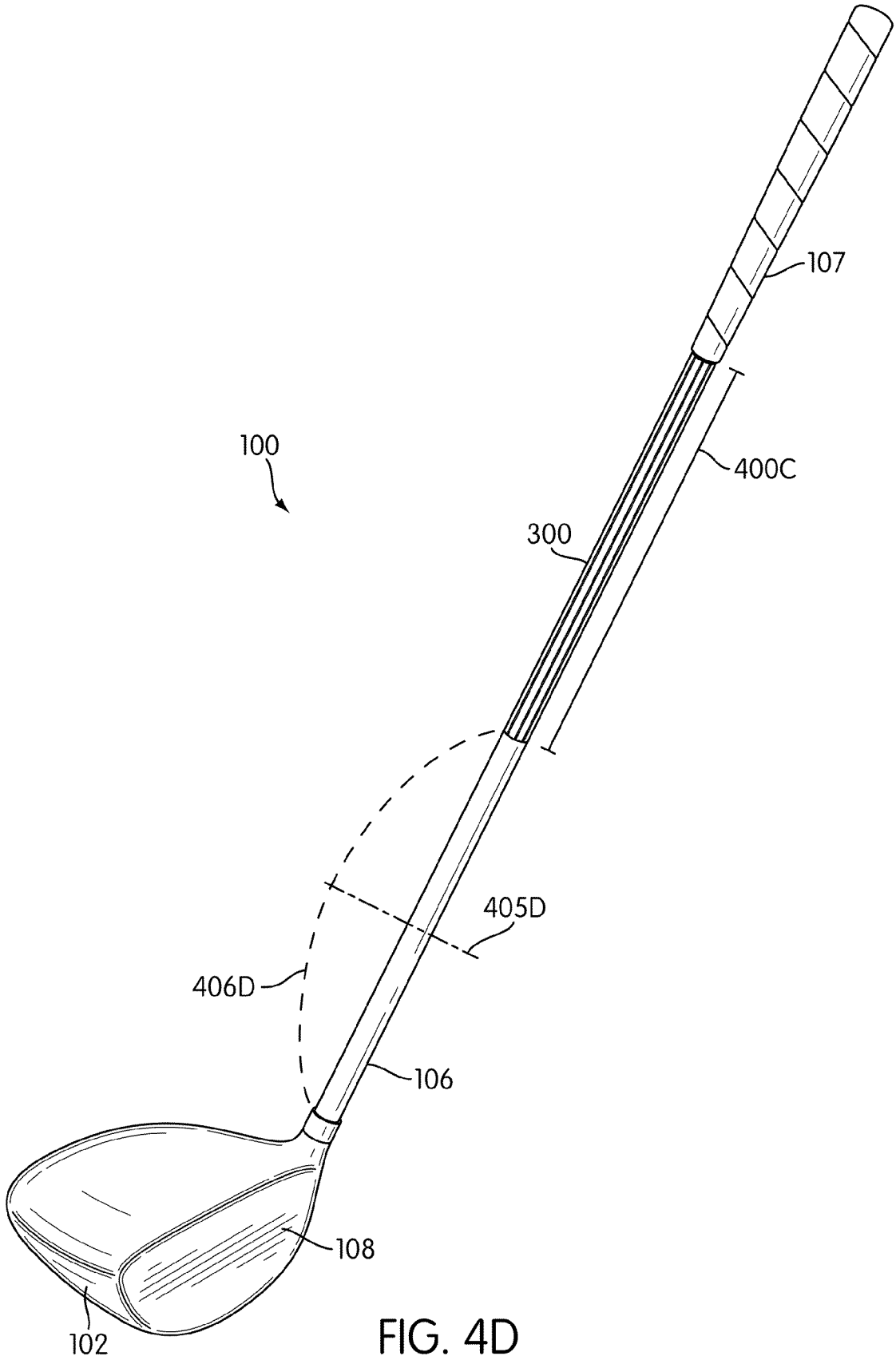

FIGS. 4B-4D illustratively show the golf club 100 with a shaft stiffening device 300 housed on a low 400A, mid 400B, and high 400C sections of the shaft 106. FIGS. 4B-4D also demonstrate the effect a shaft stiffening device 300 has on various golf club 100 characteristics including the flex length (as shown in the respective maximum states of flex, 406B-406D) and the location of the kick point 405B-405D. FIG. 4B illustratively shows the golf club 100 with shaft stiffening device 300 positioned on the low section 400A of the shaft 106 adjacent to the golf club head end 102. The shaft stiffening device 300 is engaged with the exterior of the shaft 106. The shaft stiffening device 300 engaging the low section 400A of the shaft 106 causes the portion of the shaft inward of the shaft stiffening device 300 to exhibit an increased stiffness characteristic down the length between the ends of the shaft stiffening device 300. Here, the stiffness characteristics have been altered such that the shaft 106 is more rigid in the low section 400A of the shaft of the golf club 106. Accordingly, the portion of the shaft that exhibits flex or bending can be changed as can the associated flex length 406B. Additionally, the kick point 405B is shifted upward further towards the high section 400C and the grip 107 of the golf club.

FIG. 4C illustratively shows the golf club 100 with shaft stiffening device 300 housed on the mid section 400B of the shaft 106 of the golf club head 100. Similarly, the shaft stiffening device 300 causes the mid section 400B to exhibit increased stiffness characteristics and, in particular, fairly rigid characteristics. Accordingly, the shaft 106 now has two flex length regions 406C. Additionally, the shaft in the configuration of FIG. 4C also has a pair of kick points 405C on opposite sides of the shaft stiffening device 300.

Lastly, FIG. 4D illustratively shows the golf club 100 with shaft stiffening device 300 housed on the high section 400C of the shaft 106. The high section 400C of the golf club shaft is shown as having an increased stiffness trait as the shaft 106 in this region is illustrated as being held generally rigid by the shaft stiffening device 300. Accordingly, flex length 406D extends down near golf club head 102 end of the golf club 100. Also, the kick point 405D has a varied location.

As shown and described, the shaft stiffening device 300 can be positioned at a particular region. As such, the shaft 106 can be further supported and in that particular region will exhibit increased stiffness characteristics. The extent to which the stiffness characteristics are varied will depend on various characteristics potentially including the original shaft stiffness, the length of the shaft stiffening device 300, the material composition of the shaft stiffening device 300, swing characteristics of the golfer and other specific characteristics. Also, as shown, the shaft stiffening device 300 may be further formed and positioned to engage the shaft 106 so as to modify the shaft characteristics as desired without altering other features of the golf club 100. For example, to provide a continuous and smooth feel to the golfer, when a shaft stiffening device 300 is specifically configured for the high section 400C of the shaft, the shaft stiffening device 300 may be formed in one arrangement such that the end abuts the lower end of the grip 107 such that an outer surface of the grip is flush with the shaft stiffening device 300. As such, the shaft stiffening device 300 when positioned as shown provides the feel of a single elongated grip 107 rather than a distinct structure near the top of the shaft 106. As such, improved feel characteristics may be accomplished while still accomplishing the shaft characteristic altering function as desired.

Further, it is noted that because the shaft stiffening device 300 is adjustable in its length, the shaft stiffening device 300 may be adjusted within sections 400A, 400B, 400C so as to finely adjust the shaft stiffness altering effect of the shaft stiffening device 300 by including a specific portion of the shaft 106 caused to be stiffened or a shifted location of the kick point 205 to occur.

While the regions of the shaft 106 within the shaft stiffening device 300 are shown as exhibiting no flex for illustrative purposes in the diagrams of FIGS. 4A-4C, the shaft 106 in these regions may exhibit reduced flex rather than no flex in various configurations. As such, the shaft characteristics including shaft stiffness characteristics may be accomplished consistent with that described herein as the "reduced flex" regions will have similar effects as "no flex" regions on the characteristics and functionality of the shaft, perhaps with just variances in degrees and extent of certain characteristics. Likewise, while the region of the shaft 106 within the grip 107 is shown as not having a flex region in FIGS. 4A-4D, this region may have some flex characteristics (such as a reduced flex characteristic) as a result of the golfer gripping this region with his hands when swinging the club in the configurations of FIGS. 4A-4D as the golfer's hands may not act exactly as a clamp consistent with that shown in FIG. 2B.

Golf professionals are known to work with golfers to assist them in improving their golf game including their swing and associated play by analyzing the golfer's tendencies, providing instruction and recommendation regarding modifications to their swing and also in recommending various equipment including selection of clubs. Further, a golf professional for a certain golf manufacturer may offer a selection of features for which the golfer may select either alone, or with the assistance of the golf professional. Among the features that vary from golf club to golf club are various shaft characteristics including length, stiffness, kick point, grip type, feel and many others. Each golfer may have a swing tendency that varies from other golfers. Accordingly golfers may desire and benefit from an individualized fitting of a golf club such that the golfer's swing characteristics and swing tendencies may be noted and accounted for. In a fitting process, a golfer may have his or her swing analyzed by a professional either visually or by using any of various measuring and analysis devices known in the art and will be described further below.

Figure 5A:
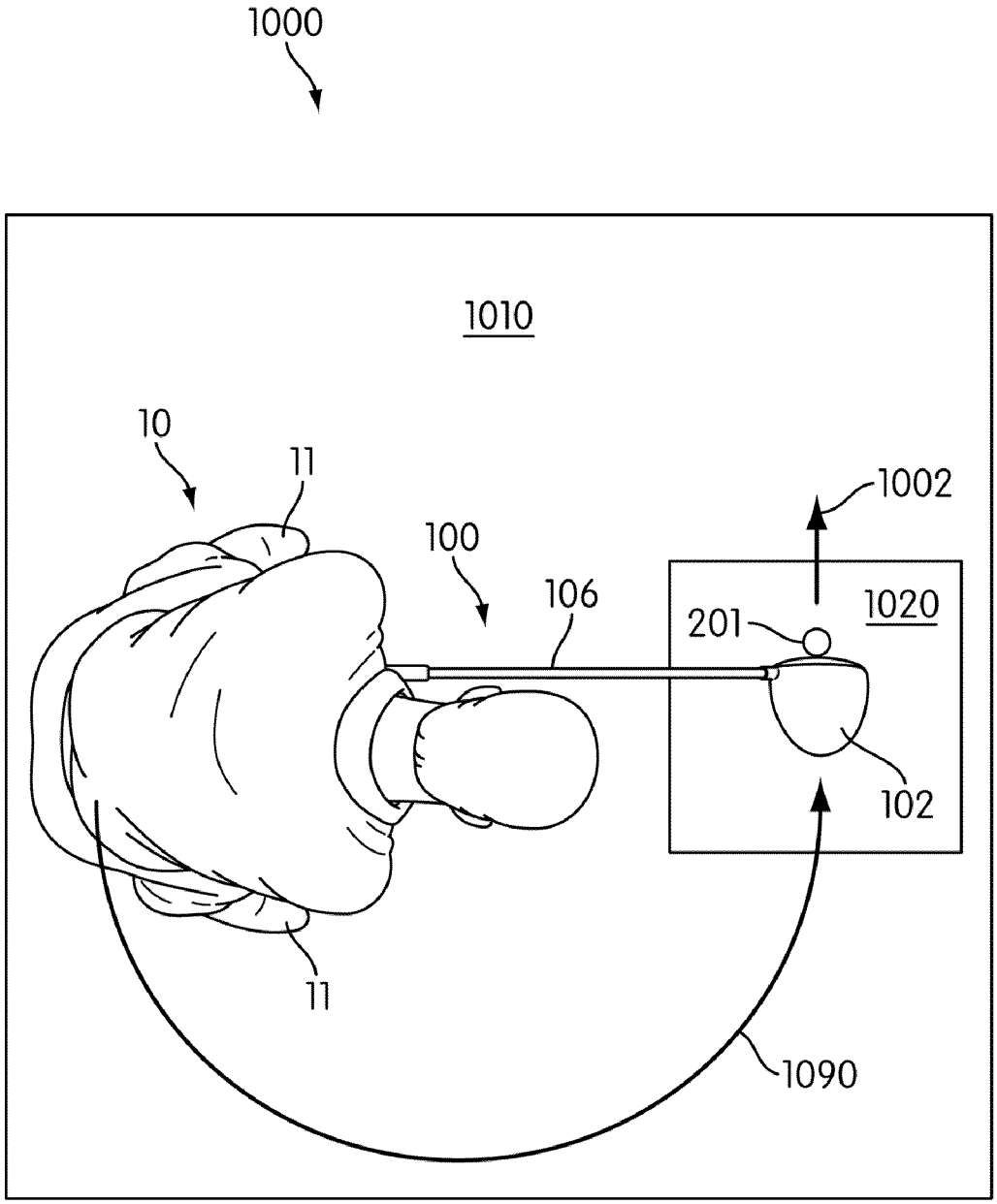
FIGS. 5A-5C illustratively depict aspects of a method of fitting a golf club and associated devices.
Figure 5B:
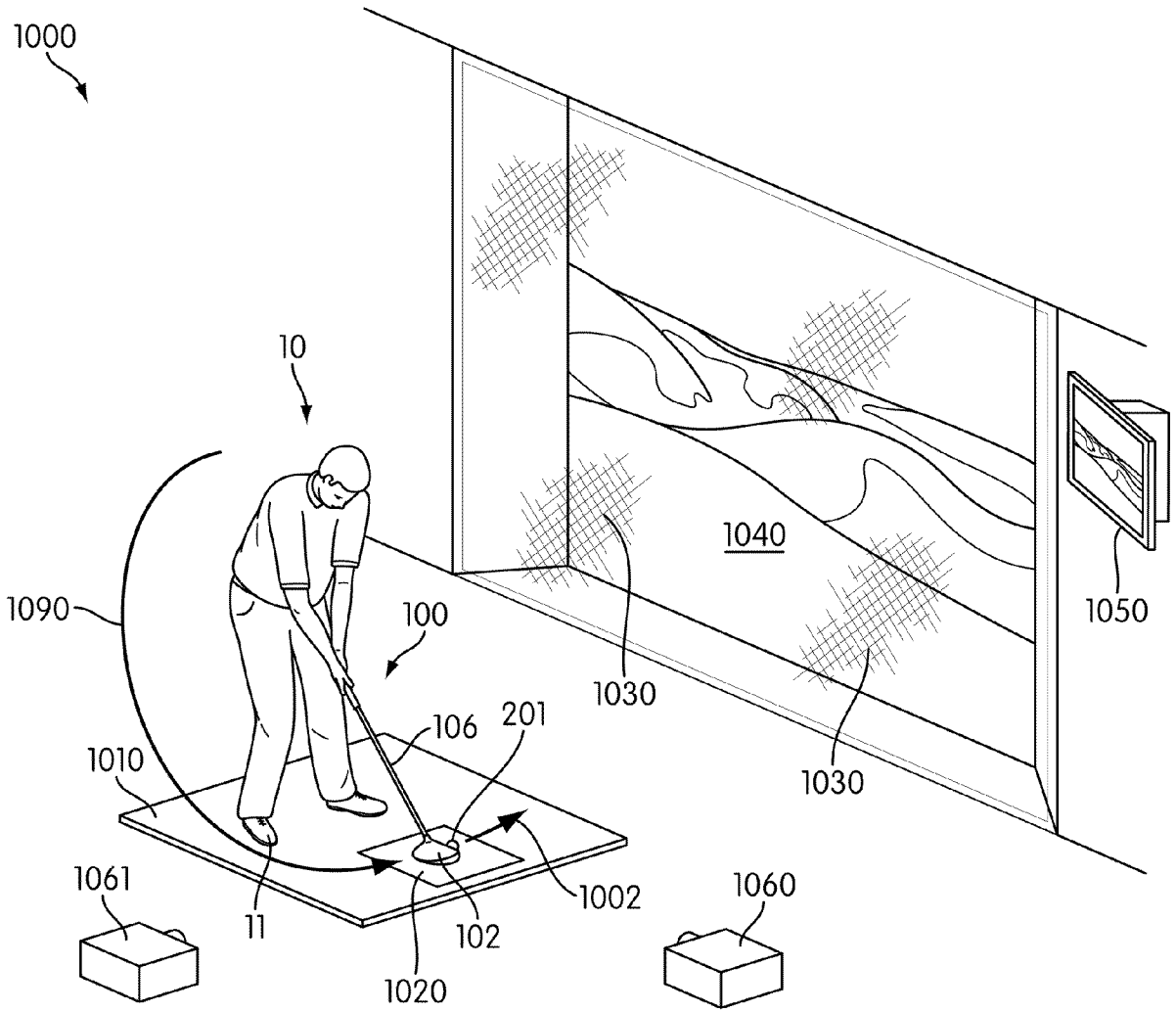
Figure 5C:
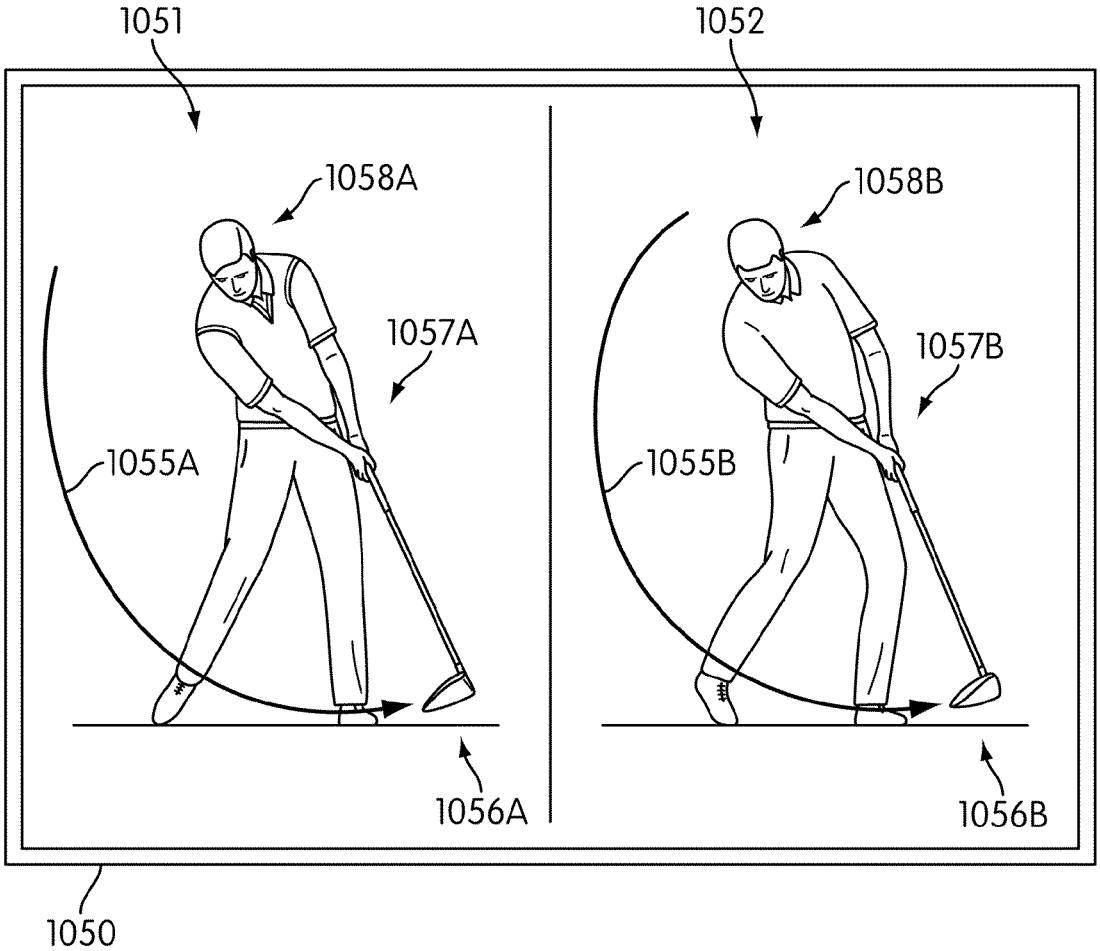

FIGS. 5A-5C illustratively depict one manner of fitting a golf club 100 including a shaft 106. As is known, a golfer 10 may perform a number of swings in front of one or more golf professionals or golf club fitters. The movements including the golf swing may be viewed, recorded, and/or measured by a measuring device including a videographic device like a digital video camera. FIGS. 5A and 5B illustrate top plan and rear views respectively of a golfer swinging a golf club and hitting golf balls in an illustrative fitting station 1000. The fitting station 1000 may have any of a number of arrangements and features. The fitting station 1000 shown in FIGS. 5A-5C is an indoor fitting station. However, fitting station 1000 may be indoor or outdoor and may be located at a driving range or other practice facilities, at a golf course including in or near a pro shop and various other locations as are known. The fitting station 1000 may include a hitting mat 1010, especially when the fitting station is an indoor station or when the station is part of a driving range. Although, a fitting station may occur on a grass tee box or other outdoor natural golf environment. Here, the indoor fitting station 1000 also includes a net 1030 that a golfer 10 may hit the ball into in performing his or her shots, practice swings and swings in front of a golf professional or golf club fitter. The net 1030 permits the fitting to be done in a more limited space such as indoors, in a pro shop or in a driving range with limited land available. Behind the net 1030 may be a background 1040 or other structures that may make the golfer feel as if he is on the golf course. Also, while not specifically depicted, the background may house or protect a further measuring device(s) including velocity or force sensors, videographic devices and other devices that may be utilized in the fitting of the golfer.

The ball travel of a golfer's shot may be monitored by watching an entire ball flight at a fitting station on a driving range that possesses sufficient space for the ball to travel until it comes to a natural stopping point/lie. Also, a golfer may also hit in a confined spaced monitored by a digital video camera or other computing devices that can determine the travel path based upon initial characteristics of the shot including velocity, trajectory, spin etc. Further measuring devices may be used to further understand the swing path and related tendencies of a golfer. In one example configuration, a golfer's swing may be filmed using a digital video camera device 1060. In particular the golfer's swing may be filmed from a toe end view such that the golfer has a stance square to and facing the camera. In another configuration, the golfer's swing my alternatively or additionally be filmed by a measuring device positioned at a position such as the position where measuring device 1061 is illustratively shown. By filming the golfer's swing from square orientations such as the rear and toe end, the video may be compared to images and swing paths performed and recorded by a golfer having preferred mechanics as shown in FIG. 5C.

Among the devices and tests that may be used to monitor the swing path, contact orientation and related characteristics of a golfer swing are video recording, radar tracking including Doppler radar technology, motion detection devices, speed radar devices, ball flight tracking devices and monitoring systems and similar golf swing analysis devices as are known in the art. These measuring devices may be positioned as illustrative measuring devices 1060, 1061 are shown as being positioned. These devices may also be positioned in front of the golfer 10 such that the golfer is hitting at the measuring device or on the heel end side of the golfer behind the golfer's back. Even further, measuring devices may be placed overhead or practically anywhere such that the measuring devices can record data such as video images of the golfer's movements or track and record data or characteristics associated with the portions of the golf club or ball movement such as velocity, direction, orientation, and other characteristics as are known. Other devices focused at determining the golf club's orientation during the swing and in particular the orientation of the golf club through the hitting zone when the golf club head strikes the golf ball may be utilized. These devices may be the same or similar devices as the videographic, radar or other motion tracking devices or the devices may be as simple as lie board devices which depict where a bottom surface of the golf club contacts the ground and the direction of movement and orientation of the club through the hitting zone. Also basic tape devices placed over the hitting surface 1020 of a golf club head may be used to provide data regarding the portion of the hitting surface 1020 where the golf ball is being hit to determine whether the ball is being hit in a sweet spot or off-center such that the swing or club may need adjustment to optimize results.

After a sufficient number of swings and "practice" or "sample" shots have been made to provide a desired sampling of shots to provide for a reliable fitting, the golf and/or fitting professionals can use the data collected to recommend a particular golf club head 102 housing a visual swing indicator that will help the golfer performing a golf swing more regularly according to traditional preferred swing mechanics. Among the characteristics collected or measured may include swing path data, trajectory, orientation of the golf club on impact, ball spin, ball flight and physical dimensions and ergonomic characteristics of the golfer, to name just a few. The analysis of the swings including swing patterns can be used to determine a desired swing path, tendencies of the golfer's swing, and changes to the golfer's current swing path such that the specific changes required may be more visibly noticeable. The bend and flex characteristics may be determined and shown such that an analysis (e.g., computer analysis) can be performed to determine whether a club shaft of a club is appropriate as maximizing the performance of a golfer with particular swing tendencies. For example, preferred stiffness, preferred location of kick point and effects of a shaft stiffening device located at certain locations.

FIG. 5C illustrates a display 1050 depicting two respective swing characteristics outputs 1051, 1052 illustratively depicting two swings of golfers in videographic form such as digital video. In one arrangement the displayed swing 1051 may be a videographic image of preferred swing of a professional golfer or other golfer including a "virtual golfer" with preferred swing mechanics. On the right, the golf swing 1052 may be an actual swing of a golfer 10 currently being analyzed in the fitting station 1000. Through the split screen comparison on display 1050, a golfer may be analyzed and fitted for a particular golf club features such as visual swing indicators, shaft characteristics, and alignment aides and other features to facilitate a golfer swinging in a preferred manner to achieve preferred performance. For example, backswing paths 1055A, 1055B of the golfers may be compared during the swings 1051, 1052. Likewise, the orientations of the golf club head 1056A, 1056B, the golfers' arm and hand positions 1057A, 1057B, and the head positions 1058A, 1058B may be compared visual. Other comparisons and analysis may be performed as is known. While the display 1050 here illustrates videographic information relating to the golfers' swings, the display 1050 may be utilized during other aspects of the analysis including output of various other characteristics utilized in fitting the golfer 10. Further, as shown in FIG. 5B the display 1050 may also be used to enhance the fitting experience and may be visible to the golfer during the fitting process. However, various configurations of outputs can be used to perform a swing analysis and provide output data relating to the golfer's swing to the golfer or the golf professional.

Therefore, using the above described fitting processes, the stiffening strip 300 can be particularly utilized to adjust and control flexibility and stiffness characteristics of the golf club shaft 106, such as flex, stiffness and the position of the kick point to customize the golf club shaft 106 to fit particular swing types or a golfer's tendencies. For example, the above described fitting processes could be used in conjunction with a method for fitting a shaft of a golf club with a stiffening strip 300. The method includes determining a stiffness characteristic of the shaft of the golf club and determining a desired stiffness characteristic of the shaft based upon a swing of the golf club using a measuring device. The method further includes selecting a particular stiffening strip from a plurality of available stiffening strips based upon the determined desired stiffness characteristic and engaging the selected stiffening strip 300 to the golf club shaft wherein a longitudinal axis of the stiffening strip extends in a direction parallel to a longitudinal axis of the golf club shaft when the stiffening strip 300 is engaged with the golf club shaft. The method further includes positioning the particular stiffening strip on the golf club shaft at a particular position on the shaft that will provide the desired stiffness characteristic. The method could further include a step of determining a desired flex point of the shaft.

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

For example, while wood-type golf clubs are discussed in detail above, this is not intended to suggest that iron-type golf clubs are outside the scope of this disclosure. On the contrary, iron-type golf clubs such as, iron-type hybrid clubs, driving irons, 0 through 10 irons, wedges (e.g., pitching wedges, lob wedges, gap wedges, sand wedges, etc.), chipping clubs, etc. are included within the scope of this disclosure. Such iron-type golf clubs may include an iron-type club head body that has a ball striking face portion, a rear portion opposite the ball striking face, a crown (or top) portion, a sole portion, a toe end portion and a heel end portion.

We claim:

1. A device for stiffening a golf club shaft comprising:

a strip of material configured to engage the exterior of the golf club shaft, wherein a longitudinal axis of the strip is configured to extend in a direction parallel to a longitudinal axis of the golf club shaft when the strip engages the golf club shaft, wherein the strip is configured to increase the stiffness of a portion of the golf club shaft when the strip engages the portion of the golf club shaft, wherein the strip is configured for removable engagement with the exterior of the golf club shaft, wherein the strip includes longitudinal fibers that are configured to extend in a direction parallel to the longitudinal axis of the golf club shaft when the strip engages the golf club shaft, and wherein the strip is rigid with a predetermined curvature that matches the curvature of the exterior of the golf club shaft.

2. The device for stiffening a golf club shaft according to claim 1, wherein the strip is a tape which includes an adhesive surface that is configured to engage the exterior of the golf club shaft.

3. The device for stiffening a golf club shaft according to claim 1, wherein the strip includes a second set of fibers that are configured to extend in a direction which is different than the longitudinal axis of the golf club shaft when the strip engages the golf club shaft, such that the second set of fibers overlap with the longitudinal fibers that are configured to extend in a direction parallel to the longitudinal axis of the golf club shaft when the strip engages the golf club shaft.

4. A golf club shaft kit comprising:

a golf club shaft; and a strip of material configured to engage to the exterior of the golf club shaft, wherein a longitudinal axis of the strip is configured to extend in a direction parallel to a longitudinal axis of the golf club shaft when the strip engages the golf club shaft, wherein the strip is configured to increase the stiffness of a portion of the golf club shaft when the strip engages the portion of the golf club shaft, wherein the strip is configured for removable engagement with the exterior of the golf club shaft, wherein the strip includes longitudinal fibers that are configured to extend in a direction parallel to the longitudinal axis of the golf club shaft when the strip engages the golf club shaft, and wherein the strip is rigid with a predetermined curvature that matches the curvature of the exterior of the golf club shaft.

5. The golf club shaft kit according to claim 4, wherein the strip is a tape which includes an adhesive surface configured to engage the exterior of the golf club shaft.

6. The golf club shaft kit according to claim 4, wherein the strip is configured to extend around a portion of the circumference of the golf club shaft that is less than the entire circumference of the golf club shaft.

7. The golf club shaft kit according to claim 4, wherein the strip is a length that is less than the length of the golf club shaft.

8. The golf club shaft kit according to claim 4, the strip is configured to engage different locations along the golf club shaft.

9. The golf club shaft kit according to claim 8, wherein a kick point of the golf club shaft is dependent on the location at which the strip engages the golf club shaft.

10. The golf club shaft kit according to claim 8, wherein the strip is configured and sized to fit within one of a low section, a mid section, and a high section of the golf club shaft.

11. The golf club shaft kit according to claim 4, further comprising at least two strips of material configured to be engaged to the exterior of the golf club shaft.

12. The golf club shaft kit according to claim 4, further comprising: a golf club head body and a grip.

13. The golf club shaft kit according to claim 4, wherein the strip includes a second set of fibers that are configured to extend in a direction which is different than the longitudinal axis of the golf club shaft when the strip engages the golf club shaft, such that the second set of fibers overlap with the longitudinal fibers that are configured to extend in a direction parallel to the longitudinal axis of the golf club shaft when the strip engages the golf club shaft.

14. A golf club comprising:

a golf club head body;

a golf club shaft;

a grip; and a strip of material configured to engage to the exterior of the golf club shaft, wherein a longitudinal axis of the strip is configured to extend in a direction parallel to a longitudinal axis of the golf club shaft when the strip engages the golf club shaft, wherein the strip is configured to increase the stiffness of a portion of the golf club shaft when the strip engages the portion of the golf club shaft, wherein the strip is configured for removable engagement with the exterior of the golf club shaft, wherein the strip includes longitudinal fibers that are configured to extend in a direction parallel to the longitudinal axis of the golf club shaft when the strip engages the golf club shaft, and wherein the strip is rigid with a predetermined curvature that matches the curvature of the exterior of the golf club shaft.

15. The golf club according to claim 14, wherein the strip is a tape which includes an adhesive surface that is configured to engage the exterior of the golf club shaft.

16. The golf club according to claim 14, wherein the strip extends around a portion of the circumference of the golf club shaft that is less than the entire circumference of the golf club shaft.

17. The golf club according to claim 14, wherein the strip is a length that is less than the length of the golf club shaft.

18. The golf club according to claim 17, wherein the strip is configured to engage different points along the golf club shaft.

19. The golf club according to claim 18, wherein a kick point of the golf club shaft is dependent on the location at which the strip engages the golf club shaft.

20. The golf club according to claim 18, wherein the strip is configured and sized to fit within one of a low section, a mid section, and a high section of the golf club shaft.

21. The golf club according to claim 14, further comprising at least two strips of material configured to engage the exterior of the golf club shaft.

22. The golf club according to claim 14, wherein the strip includes a second set of fibers that are configured to extend in a direction which is different than the longitudinal axis of the golf club shaft when the strip engages the golf club shaft, such that the second set of fibers overlap with the longitudinal fibers that are configured to extend in a direction parallel to the longitudinal axis of the golf club, shaft when the strip engages the golf club shaft.

* * * * *